United States Patent [19]

Markowitz

[11] Patent Number: 4,877,075

[45] Date of Patent: Oct. 31, 1989

[54] WINDOW SHADE ASSEMBLY

[76] Inventor: Steven Markowitz, 719 Greenwich St., No. 2 South, New York, N.Y. 10014

[21] Appl. No.: 586,771

[22] Filed: Mar. 6, 1984

[51] Int. Cl.[4] ..... A47H 5/032

[52] U.S. Cl. ..... 160/84.1

[58] Field of Search ..... 160/84 R, 340, 341, 160/330, 344, 370

[56] References Cited

U.S. PATENT DOCUMENTS

| | | | |
|---|---|---|---|
| 737,666 | 9/1903 | Sabey | 160/370 |
| 923,892 | 6/1909 | Robinson | 160/370 |
| 1,407,248 | 2/1922 | Brown | 160/84 R |
| 1,735,382 | 11/1929 | Etkins | 160/370 |
| 2,295,137 | 9/1942 | Sutton | 160/84 R |
| 2,910,120 | 10/1959 | Rosen | 160/344 |
| 3,013,604 | 12/1961 | Roberts | 160/344 |
| 3,160,202 | 12/1964 | Rosen | 160/344 |
| 3,439,725 | 4/1969 | Haimovitz et al. | 160/84 R |
| 4,088,170 | 5/1978 | Franklin | 160/84 R |
| 4,250,597 | 2/1981 | Ford et al. | 160/370 X |

*Primary Examiner*—Ramon S. Britts
*Assistant Examiner*—David M. Purol
*Attorney, Agent, or Firm*—Kenyon & Kenyon

[57] ABSTRACT

A window shade mounting assembly includes at least one tubular formation or channel extending substantially the width of a window shade proximate and parallel to an upper end or edge thereof for receiving a curtain rod and cooperating therewith to support the window shade in opposition to the force of gravity. The mounting assembly also includes a plurality of pulleys each having on one side and on a lower end a rotatably mounted roller and, on an end and a side of the pulley opposite the roller, a hook shaped mounting element which is insertable through apertures in the tube of the window shade and which can be snapped onto the curtain rod. The pulleys support cords or strings which are connected to a lower end of the window shade for alternately raising and lowering that lower end in response to manipulations by an operator.

6 Claims, 2 Drawing Sheets

WINDOW SHADE ASSEMBLY

BACKGROUND OF THE INVENTION

This invention relates to window shades and, more particularly, to a window shade mounting assembly.

Window shades generally comprise three main components; the fabric sheet or web forming the body of the shade, an elongate carrier attached to one end of the shade for fastening the shade to a window frame, and shade adjustment means including ropes or cords suspended from pulleys mounted to the carrier for enabling the raising and lowering of the window shade in response to manipulations by an operator. The window shade fabric, as well as the pulleys, are generally permanently fixed to the carrier or headboard, which can take the form of a valance. The difficulty or impossibility of removing such a window shade from the carrier without damaging the window shade fabric has long been a disadvantage to the use of window shades as compared with other window coverings such as curtains and drapes.

An object of the present invention is to provide an improved window shade assembly in which the window shade fabric is easily removable from supporting members. Another object of the present invention is to provide such a window shade assembly in which the window shade is easily mountable on existing window covering support structures such as curtain rods.

SUMMARY OF THE INVENTION

In a window shade assembly in accordance with the present invention a window shade fabric having an upper end and a lower end is removably securable to a curtain rod by first support means having an elongate dimension extending substantially parallel and proximate to the upper edge of the window shade, the first support means engaging the curtain rod and cooperating therewith to support the window shade in opposition to the force of gravity. Second support means is attached in part to the lower edge of the window shade fabric and includes a plurality of pulleys removably attachable to the curtain rod at spaced intervals therealong for raising and lowering the lower end of the window shade fabric in response to manipulations by an operator.

In accordance with a particular feature of the present invention, each of the pulleys comprises an elongate plate shaped body member, a roller rotatably attached to the body member on one side and at one end thereof and, on a side and an end of the body member opposite the roller, a securing element for temporarily attaching the respective pulley to the curtain rod. The securing element is advantageously hooked shaped and resilient and provided at a free end with a projection extending towards the body member for engaging the curtain rod in a snap lock fit.

In accordance with another particular feature of the present invention, the first support means includes at least one tubular formation on the window shape fabric proximate to the upper end or edge thereof and extending in the direction of the elongate dimension of the first support means. The curtain rod longitudinally traverses the tubular formation in an assembled state of the window shade mounting assembly. The tubular formation extends preferably the entire width of the window shade fabric and is provided with a plurality of apertures equal in number to the pulleys and spaced from one another along the length of the tubular formation, the securing element of the pulleys being at least partially insertable through the apertures to engage the curtain rod.

In contrast to traditional window shade designs, a window shade mounting assembly according to the present invention enables the mounting of window shades to existing window covering support structures such as curtain rods and greatly facilitates the removal of the window shades from the support members for cleaning or replacement. A window shade mounting assembly according to the present invention is simple to manufacture and easy to install.

DETAILED DESCRIPTION

Figure 1:
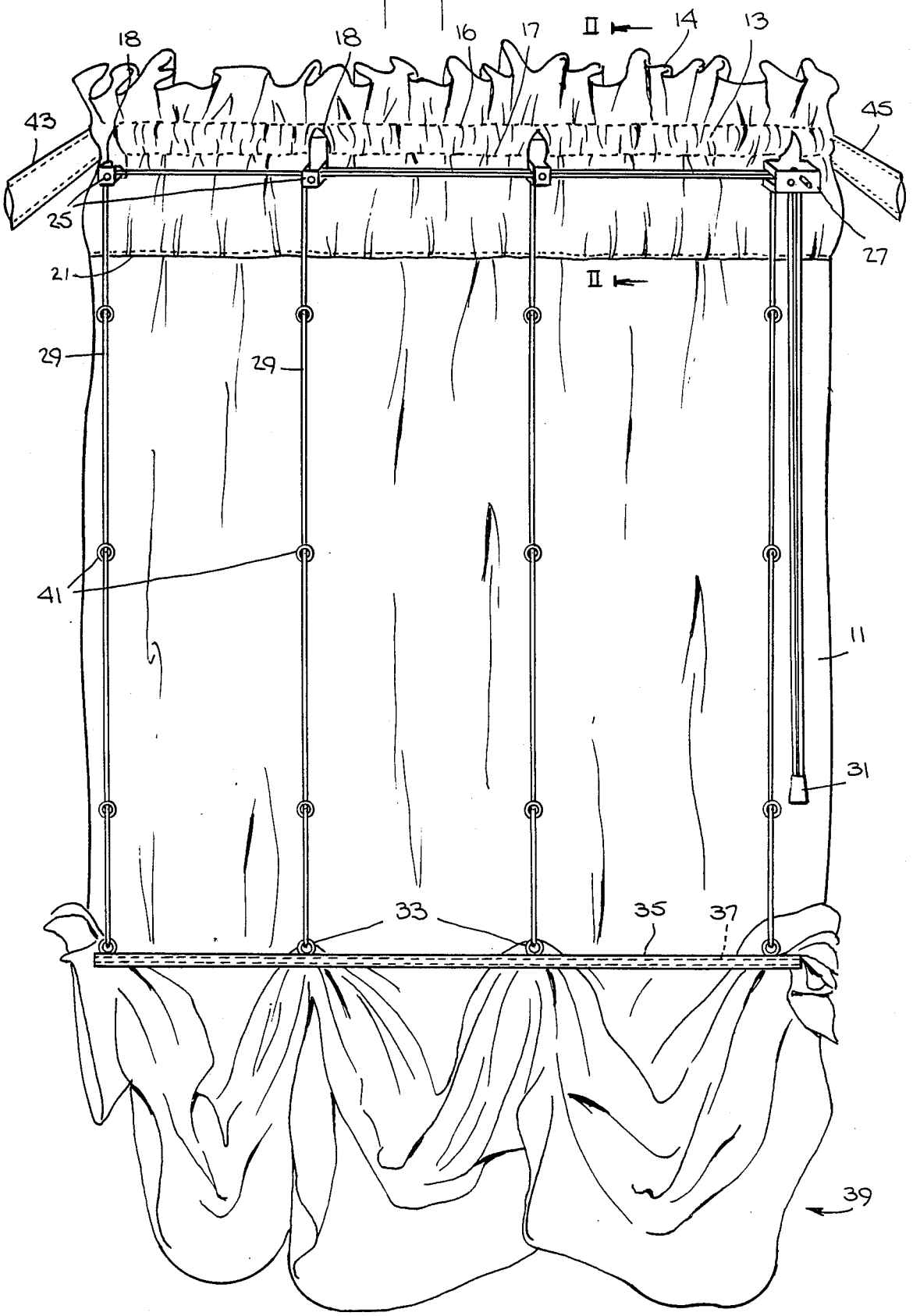
FIG. 1 is a partially schematic rear elevational view of a window shade mounted on a curtain rod by means of an assembly according to the present invention, showing two kinds of pulleys.
Figure 2:
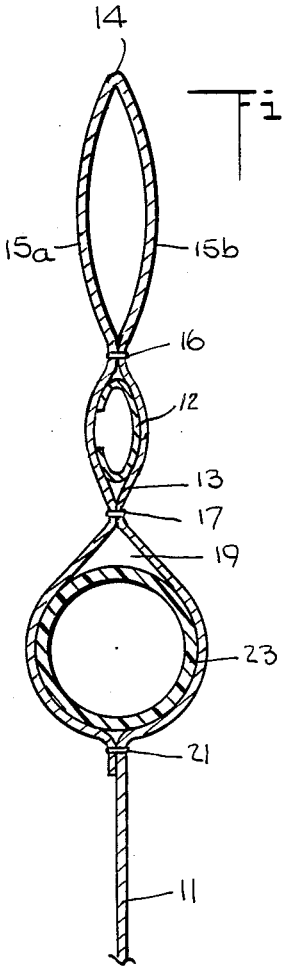
FIG. 2 ia partial cross-sectional view taken along line II—II in FIG. 1.

As illustrated in FIGS. 1 and 2, a window shade 11 is mountable on a curtain rod 12 by means of an elongate channel or tubular formation 13 extending substantially the entire width of the window shade fabric parallel to and proximate to an upper edge 14 thereof. Curtain rod 12 longitudinally traverses channel or tube 13 and cooperates therewith to support window shade fabric 11 in opposition to the force of gravity. Channel or tube 13 is advantageously formed by folding an upper end of the window shade fabric back upon itself and stitching the overlapping layers 15*a* and 15*b* (see FIG. 2) to one another along a pair of parallel seams 16 and 17. A tubular holder 19 may be similarly formed by stitching fabric layers 15*a* and 15*b* to each other along yet another seam 21. Tubular holder 19 serves to carry a cylindrical expansion member 23 for enhancing the decorative aspect of the window shade.

Tube 13 is provided with a multiplicity of equispaced vertically extending slits or apertures 18, whereby respective pulleys 25 and 27 are inserted through fabric layer 15*a* into tube 13 and are engaged with curtain rod 12. Pulleys 25 perform in part the conventional function of changing the direction of tensile load bearing elements in the form of cords or strings 29, while pulley 27 performs in addition a control function of grasping or catching cords 29 and preventing them from moving under the influence of gravity. Cords 29 are each fastened at one end to a common knob 31 and at their opposite ends to respective rings 33 in turn fastened to a fabric sleeve 35 at equispaced points along the length thereof, the sleeve being longitudinally traversed by a bar or shaft 37. Bar 37 serves the dual function of weighting down the lower end 39 of window shade 11 and of aligning rings 33, i.e., of ensuring that rings 33 are disposed at a common horizontal position. Each cord 29 passes through a plurality of vertically aligned guide rings 41 sewn to the fabric of window shade 11.

The lower end 39 of window shade fabric 11 is bunched togther at intervals and tied to rings 33 to improve the aesthetics of the window shade. Also serving an aesthetic function are a pair of sleeves 43 and 45 joined to window shade fabric 11 at opposite ends of tube 13 for covering mounting arms or brackets 12*a* (see FIG. 5) of curtin rod 12, which arms extend perpendicularly to the body of the rod. Obviously, sleeves 43 and 45 are dispensed with for simple curtain rods having no perpendicularly extending mounting arms.

Figure 3:
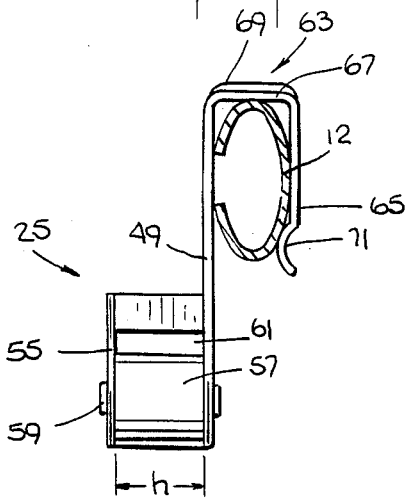
FIG. 3 is a front elevational view of one of the pulleys of FIG. 1, showing a curtain rod in cross section.
Figure 4:
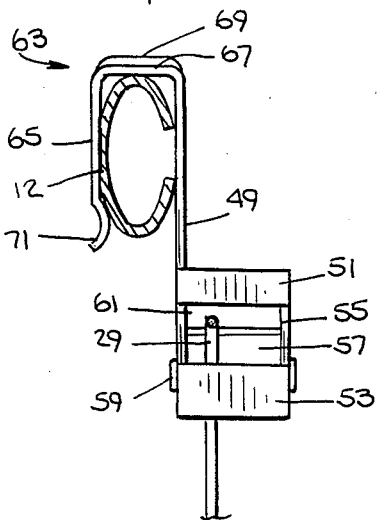
FIG. 4 is a rear elevational view of the pulley of FIG. 3.

As illustrated in FIGS. 3 and 4, each pulley 25 comprises an elongate plate 49 serving as a central structural component or body of the pulley. A pair of spaced flanges 51 and 53 are rigidly attached to an edge of plate 49 at a lower portion thereof and extend perpendicularly from the plane of plate 49. An ancillary plate 55 parallel to body member 49 and laterally co-extensive therewith is rigidly attached to the ends of flanges 51 and 53 opposite plate 49. A roller 57 having a height h substantially equal to the distance between plates 49 and 55 is rotatably mounted on an axle 59 journaled at opposite ends in plates 49 and 55. As shown in FIG. 4, the spacing between the flanges 51 and 53 and between plates 49 and 55 produces a rectangular window 61. As shown in FIG. 1, each pulley 25 has a respective cord 29 partially wound around its respective roller 57, whereby the orientation of such cord undergoes a 90° change.

At an upper end and on a side of plate 49 opposite roller 57 each pulley 25 is provided with a hook shaped mounting element 63 which comprises a pair of parallel sides or jaws formed by a plate member 65 and an upper portion of body member 49, these jaws being connected by a bight 67. Bight 67 is advantageously provided with at least one elongate boss 69 extending perpendicularly to plates 49 nd 65. The free end of plate 65 is provided with a cross-sectionally arcuate portion 71 projecting towards plate or body member 49.

Plates 49, 55 and 65 and flanges 51 and 53, as well as bight 67, are preferably metal. The gauge of the metal is sufficiently thin to allow plate 65 to bend outwardly, i.e., in a direction away from plate 49, upon a pulling of hook 63 downwardly over curtain rod 12. The metal is sufficiently resilient so that plate 65 springs back into its original position upon the completed passage of arcuate portion 71 relative to curtain rod 12 during the execution of an assembly procedure. Hook 63 and in particular arcuate projection 71 are advantageously proportioned to engage curtain rod 12 in a snap lock fit upon a completed downward stroke of pulley 25 with respect to the curtain rod.

Figure 5:
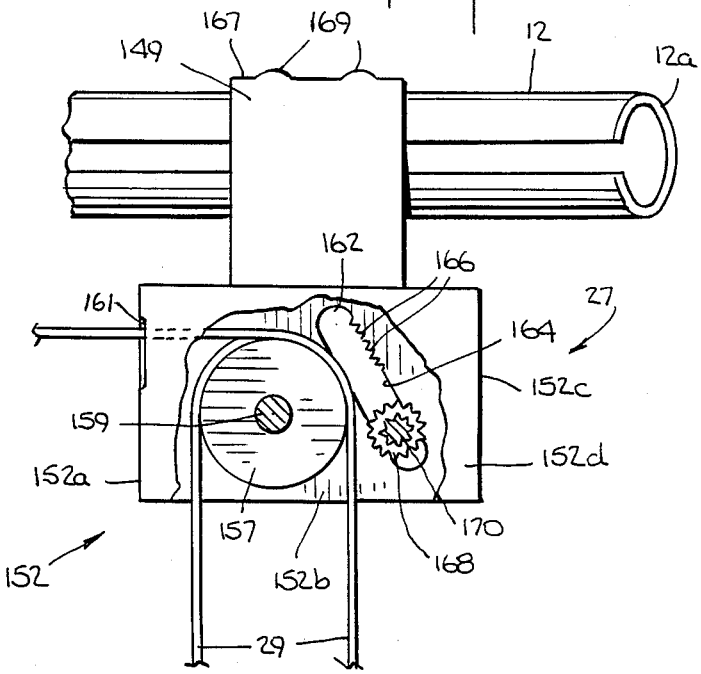
FIG. 5 is a side elevational view, partially broken away, of the second kind of pulley shown in FIG. 1.

As illustrated in FIG. 5, control pulley 27 comprises an elongate plate shaped body member 149 integral at an upper end with a bight 169 of a hook shaped mounting element (not shown) similar to hook 63 of pulley 25. Bight 167 is provided with a pair of elongate bosses 169 extending substantially perpendicularly to the plane of plate shaped body member 149. At its lower end body member 149 is integral with a prismatic pulley housing 152 which has four vertically extending sides or walls 152*a*, 152*b*, 152*c* and 152*d* and no horizontally extending walls. Side 152*a* is provided with a rectanagular opening or window 161, while housing sides 152*b* and 152*d* are provided with generally oval parallel slots 162 oriented at a angle with respect to elongate body member 149. Slots 162 are each provided on an upper portion of an upper edge 164 with a multiplicity of teeth 166.

A toothed roller 168 is movably or floatingly mounted in housing 152 by means of a toothed shaft 170, the ends of which shaft traverse slots 162. The teeth of shaft 170 are meshable with teeth 166.

A roller 157 having a height substantially equal to the distance between housing sides 152*b* and 152*d* is rotatably mounted thereto by means of an axle or shaft 159. A multiplicity of cords 29 equal in number to pulleys 25 and 27 enter housing 152 through the open lower side thereof. One of the cords negotiates a 180° turn about roller 157, while the other three cords are wound around only a 90° portion of roller 157 and emerge from housing 152 through window 161 on their ways toward pulleys 25, as illustrated in FIG. 1. Upon a lowering of the lower end 39 of window shade 11 and a simultaneous shifting of knob 31 to the right, as defined in FIG. 1, the teeth of roller 168 engage the upwardly moving cords or strings 29, whereupn roller 168 is forced upwardly along slots 162 until the teeth of shaft 170 mesh with the teeth 166 of upper slot edge 164.

The teeth of roller 168 then dig into cords 29 such that these cords are pinched in between the outer surface of roller 157 and roller 168. Further upward motion of roller 168 is prevented by a partial overlapping of roller 157 with slots 162. Upon a downward motion of knob 31 and the cords 29 fastened thereto and the simultaneous moving of knob 31 to the left, as defined in FIG. 1, toothed roller 168 drops to its lower most position, thereby freeing cords 29 for unimpeded motion with respect to roller 157.

A window shade mounting assembly in accordance with the present invention greatly facilitates the installation and removal of window shades from preexisting support structures such as curtain rods. Installation is achieved by threading the tensile force transmitting elements, namely cords 29, through pulleys 27 and 25 and through guide rings 41, tying the ends of cords 29 to rings 33, inserting curtain rod 12 through tube 13, inserting hooks 63 and the hook of pulley 27 through apertures 18 and snapping the hooks onto curtain rod 12. Removal of the window shade from the curtain rod is simply effectuated by reversing these steps.

What is claimed is:

1. An assembly for mounting a window shade on a curtain rod, said window shade having an upper end and a lower end substantially parallel thereto, comprising:

support means, having an elongate dimension extending substantially parallel and proximate to the upper end of the window shade, for engaging the curtain rod and cooperating therewith to support said window shade, said support means including at least one tubular formation on said window shade proximate to said upper end and extending substantially the entire width of said window shade in the direction of said elongate dimension, said tubular formation being provided with a plurality of apertures spaced along the length of said tubular formation, said curtain rod longitudinally traversing said tubular formation in an assembled state of the window shade mounting assembly;

a plurality of pulleys each provided with securing means insertable through said apertures and engageable with said curtain rod for removably attaching said pulleys thereto; and tensile force transmission means operatively engaging said pulleys and attached to said window shade at the lower end thereof for alternately raising and lowering the lower end of said window shade in response to manipulations of said tensile force transmission means by an operator.

2. The assembly defined in claim 1 wherein each of said pulleys includes a plate shaped body member and a roller rotatably mounted on said body member on one side thereof, said securing means including a hook shaped element engageable with said curtain rod for removably attaching the respective pulley thereto, said hook shaped element being disposed on a side of said body member opposite said roller, said hook shaped element and at least a portion of said body member being insertable through said apertures to engage said curtain rod.

3. The assembly defined in claimed 2 wherein said securing means is resilient and includes on said hook shaped element a projection extending towards said body member for engaging said curtain rod in a snap fit to lock the respective pulley to said curtain rod.

4. The assembly defined in claim 3 wherein said body member is elongated, said roller being rotatably mounted to said body member at one end thereof and said hook shaped element being integral with said body member at an end thereof opposite said roller.

5. A window shade assembly comprising:

a window shade fabric having an elongate dimension and an upper edge and a lower edge extending substantially perpendicularly to said elongate dimension, said fabric being provided with a channel proximate to said upper edge and substantially parallel thereto and with a plurality of spaced openings communicating with said channel;

a curtain rod insertable into said channel;

a plurality of pulleys equal in number to said openings and provided with securing means insertable through said openings and engageable with said curtain rod for removably attaching said pulleys thereto; and tensile force transmission means operatively engaging said pulleys and attached to said fabric at the lower edge thereof for alternately raising and lowering said lower edge in response to manipulations by an operator.

6. A window shade comprising:

a fabric sheet having an elongate dimension and an upper edge and a lower edge extending substantially perpendicularly to said elongate dimension;

a tubular formation disposed proximately to said upper edge and extending substantially parallel thereto, said tublar formation defining a channel for receiving an elongate curtain rod for supporting the window shade, said tubular formation being provided with means including a plurality of apertures spaced along the length of said channel and spaced from opposite ends of said channel for enabling the insertion into said channel of hook shaped securing elements of a plurality of pulleys and for concomitantly enabling the engagement of said curtain rod in said channel by said hook shaped securing elements; and attachment means disposed proximately to said lower edge of said fabric sheet for attaching a lower end of said fabric sheet to tensile force transmission elements engageable with said pulleys upon an insertion of said curtain rod into said channel and upon an engagement of the hook shaped securing elements of said pulleys with said curtain rod through respective ones of said apertures.

* * * * *